US005499454A

United States Patent [19]

Compton

[11] Patent Number: 5,499,454

[45] Date of Patent: Mar. 19, 1996

[54] BUTTONHOLE SCISSORS

[76] Inventor: Dorothy G. Compton, P.O. Box 4570, Suite 102, Columbia, S.C. 29204

[21] Appl. No.: 317,207

[22] Filed: Oct. 3, 1994

[51] Int. Cl.[6] ..... A41H 25/00; B26B 13/06

[52] U.S. Cl. ..... 30/120; 30/254

[58] Field of Search ..... 30/118–120, 254

[56] References Cited

U.S. PATENT DOCUMENTS

| | | | |
|---|---|---|---|
| 10,972 | 5/1854 | Brown | 30/120 |
| 247,766 | 10/1881 | Korn | 30/120 |
| 365,333 | 6/1887 | Dickenson | 30/120 |
| 667,914 | 2/1901 | Klever | 30/120 X |
| 1,482,309 | 1/1924 | Lightcap | 30/120 |

FOREIGN PATENT DOCUMENTS

| | | | |
|---|---|---|---|
| 1001765 | 12/1949 | France | 30/120 |
| 18718 | of 1901 | United Kingdom | 30/119 |
| 903 | of 1909 | United Kingdom | 30/119 |

*Primary Examiner*—Douglas D. Watts

[57] ABSTRACT

A buttonhole scissors comprising a first blade having a blunt distal end and an inner flat surface between a tapered cutting edge and an outer edge, a second blade having a pointed distal end and an inner flat surface between a tapered cutting edge and an outer edge, these blades slidable over each other with each of the inner flat surfaces in close cutting engagement, a pair of handles for the blades pivotally connected, an intermediate portion of each blade provided with a notch arranged between the cutting edge and the pivot point and cooperating to form a noncutting area which receives cloth not to be cut, and an adjustable setting means mounted through one handle and contacting the other handle, and capable of adjustment to limit the movement of the blades relative to each other.

9 Claims, 1 Drawing Sheet

BUTTONHOLE SCISSORS

The present invention relates to buttonhole scissors and more specifically to buttonhole scissors capable of being adjusted to cut various sized buttonholes.

BACKGROUND OF THE INVENTION

Buttonhole scissors have been used for more than one hundred years. Several designs for buttonhole scissors are known, but none has successfully enabled the user to quickly, accurately and efficiently open the newly sewn buttonhole without occasional disastrous mistakes of cut.

In using buttonhole scissors heretofore available, great difficulty is experienced in adjusting and setting the desired size of cut. One known buttonhole cutter offers several blades of varying sizes which may be rotated into position for cutting. When the handles of the buttonhole cutter are pressed together, the entire selected blade cuts through the fabric into which the buttonhole is to be formed. If an error was made in the selection of the blade, the resulting cut may be too small for the desired buttonhole, thus requiring a second cut. Alternatively, the resulting cut may be larger than the desired buttonhole, thus ruining the article of clothing in which the buttonhole was sewn. Even small errors in adjustment may mean cutting through the threads which form the boundary of the buttonhole, thereby undermining the strength of the buttonhole, allowing the unraveling of the fabric at the site of the buttonhole, and causing the garment into which the buttonhole was sewn to be unsatisfactory.

Other buttonhole scissors offer guidelines for determining the length of the cut, adjustment features which purport to limit the length of the cut, and even hole punching features. These features are subject to misreading, misalignment, or misuse and can not be relied upon to accurately cut the desired buttonhole size.

As a result of the above described problems and deficiencies, none of the known buttonhole scissors has successfully provided the user with a suitable tool for opening the newly sewn buttonhole.

Therefore, it is a principal object of the present invention to provide such a tool.

SUMMARY OF THE INVENTION

Accordingly, the buttonhole scissors of the present invention enable an operator to easily and accurately cut a buttonhole without cutting the surrounding threads.

An object of the present invention is to provide a easily adjustable buttonhole scissors.

Another object of the present invention is to provide buttonhole scissors capable of consistently cutting a series of buttonholes of one size.

Yet another object of the present invention is to provide buttonhole scissors designed to coordinate with the most frequently cut sizes of buttonholes.

Other and more specific objects will in part be obvious and will in part appear hereinafter.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF THE PRESENTLY PREFERRED EXEMPLARY EMBODIMENT

Figure 1:
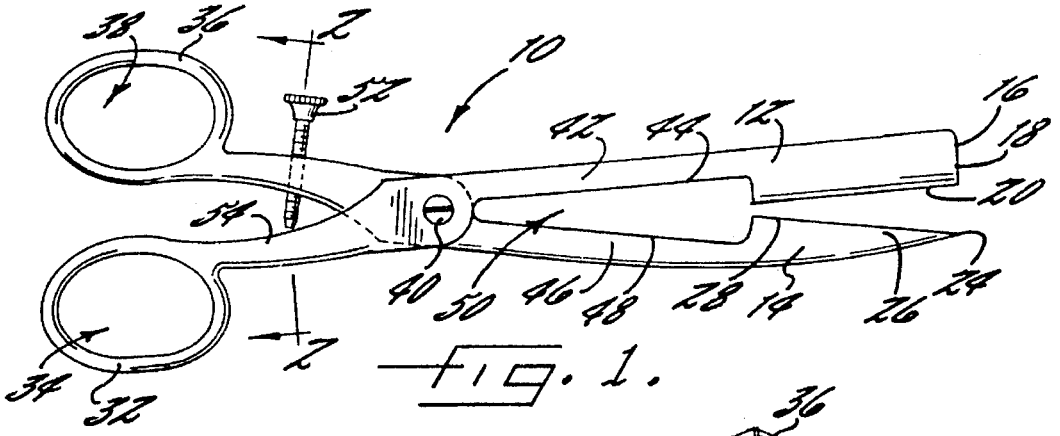
FIG. 1 is a plan view of the presently preferred embodiment of the present invention showing the scissors in an open position.
Figure 2:
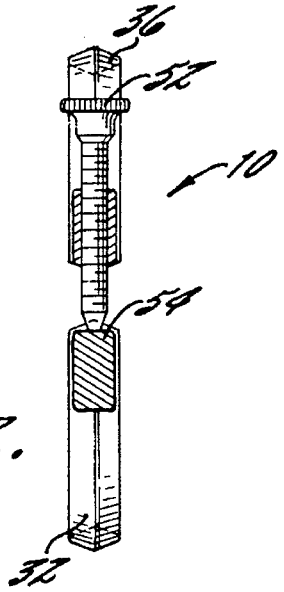
FIG. 2 is a section view on the line 2—2 of FIG. 1 looking in the direction of the arrows.
Figure 3:
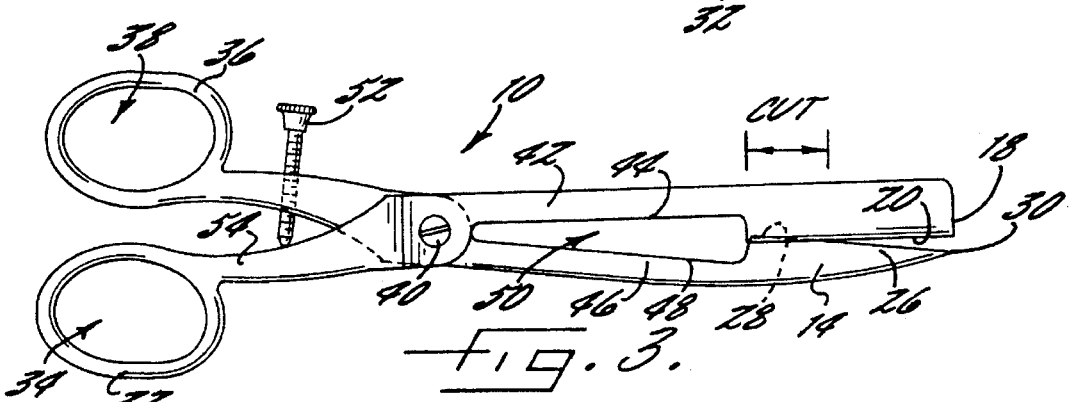
FIG. 3 is a plan view of the presently preferred embodiment of the present invention showing a partial cut.

A presently preferred embodiment of the buttonhole scissors of the present invention is illustrated in FIGS. 1, 2 and 3 by the reference numeral 10. Referring to FIG. 1, the buttonhole scissors 10 is shown in an open position with a first blade 12 above a second blade 14. First blade 12 has a blunt distal end 16, an inner flat surface 18, a tapered cutting edge 20 and an outer edge 22. Second blade 14 has a pointed distal end 24, an inner flat surface 26, a tapered cutting edge 28 and an outer edge 30.

The length of tapered cutting edge 20 may be any one of several commonly used buttonhole interior lengths. When buttonhole scissors 10 is used for cutting, as illustrated in FIG. 3, inner flat surface 18 of first blade 12 moves in close cutting engagement with inner flat surface 26 of second blade 14. This movement is accomplished by bringing the first handle 32 and the second handle 36 closer together. Normally, the user of buttonhole scissors 10 would insert a thumb in the finger loop or hole 38 of second handle 36, several fingers of the same hand in the finger loop or hole 34 of first handle 32, and place blunt distal end 16 of first blade 12 in contact with the cloth just inside the threads outlining the buttonhole desired to be opened. By laying tapered cutting edge 20 of first blade 12 along the cloth inside the threads bounding the buttonhole, a determination of the appropriate sized buttonhole scissors selection may be made. If cutting edge 20 covers the entire length of cloth inside the bounding threads, the user may squeeze thumb and fingers together, thereby cutting the buttonhole properly. First blade 12 and second blade 14 pivot about a pivotal connection 40 as first handle 32 and second handle 36 come together.

First blade 12 has an intermediate portion 42 containing a first notch 44. Second blade 14 has an intermediate portion 46 containing a second notch 48. First notch 44 cooperates with second notch 48 to form a noncutting area 50 therebetween.

Cloth that is not part of the buttonhole m be opened, that is, cloth between the outer edge of the garment and the buttonhole, may be placed in noncutting area 50 formed by first notch 44 and second notch 48, thereby being made safe from cuts.

The selection of buttonhole scissors with tapered cutting edge 20 of a length from one of several commonly used buttonhole lengths will easily assure accurate cutting of the buttonhole. Additionally, if the buttonhole to be opened is of a length not provided for by the selection of lengths, the length of cut to be made is capable of adjustment by use of the adjustable setting means 52. Adjustable setting means 52 may be a screw or the like located in second handle 36. FIG. 2 illustrates, in cross section, adjustable setting means 52 threaded through second handle 36 and contacting first handle 32 at a seat 54. By adjusting the depth to which adjustable setting means 52 is threaded through second handle 36, the length of cut possible by first blade 12 and second blade 14 is determined. As shown in FIG. 3, adjustable setting means 52 is contacting seat 54 in first handle 32 and restricting the length of close cutting engagement.

Figure 4:
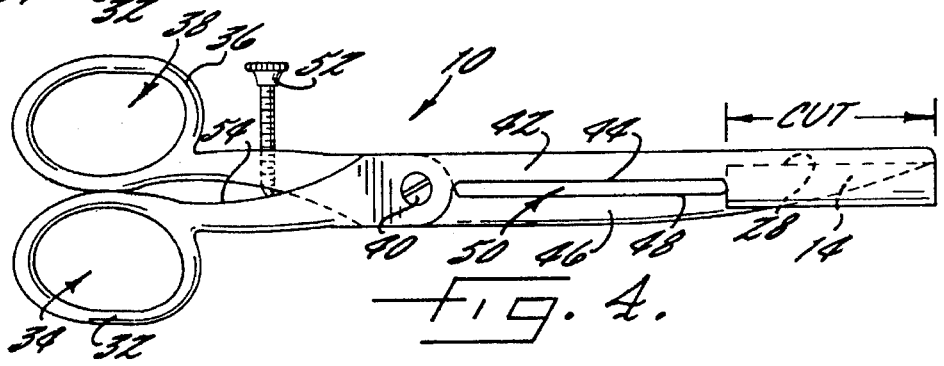
FIG. 4 is a view similar to FIG. 3 showing the presently preferred embodiment of the device of the present invention closed as at the completion of a cut.

FIG. 4 illustrates a full cut by first blade 12 and second blade 14. Adjustable setting means 52 is more shallowly threaded than in FIG. 3, and contacts seat 54 as finger loop 34 of first handle 32 meets finger loop 38 of second handle 36, thereby allowing first blade 12 and second blade 14 cut over their entire length. This length may be one of several commonly used lengths for buttonholes.

As will now be apparent, a new and improved buttonhole scissors has been disclosed which can quickly, accurately and efficiently be adjusted to a desired cutting length. Additionally, a buttonhole scissors with a cutting length appropriate to the length commonly used in construction of buttonholes has been disclosed.

Although a specific embodiment of the invention has been disclosed, various modifications may be made in the design without departing from the spirit and scope of the invention. Other variations in the implementation of the invention will be apparent to those of skill in the art.

What is claimed is:

1. A buttonhole scissors comprising:

a first blade having a blunt distal end and an inner flat surface between a tapered cutting edge and an outer edge, a second blade having a pointed distal end and an inner flat surface between a tapered cutting edge and an outer edge, said first blade and said second blade slidable over each other with each of said inner flat surfaces in close cutting engagement, a first handle of said first blade, a second handle of said second blade pivotally connected to said first handle, an intermediate portion of said first blade, provided with a first notch, said first notch being smooth and having a relatively constant depth, arranged between said cutting edge and its pivot, an intermediate portion of said second blade, provided with a second notch, said second notch being smooth and having a relatively constant depth, arranged between said cutting edge and its pivot, said first and second notches cooperate to form a noncutting area which receives cloth not to be cut, and an adjustable setting means mounted through said second handle and contacting said first handle, said setting means capable of adjustment to limit the movement of said first and said second blades.

2. A buttonhole scissors as in claim 1, wherein said first and said second handles each has a finger hole portion opposite said pivotal connection.

3. A buttonhole scissors as in claim 1, wherein said adjustable setting means is a screw threadable through said second handle.

4. A buttonhole scissors as in claim 1, wherein said noncutting area formed by cooperation of said first and second notches is of sufficient size to avoid bunching of cloth not to be cut.

5. A buttonhole scissors as in claim 1, wherein said first and second cutting edges are of a length frequently used in the making of buttonholes.

6. A method of cutting buttonholes comprising:

a buttonhole scissors with a first blade having a blunt distal end arid an inner flat surface between a tapered cutting edge and an outer edge, a second blade having a pointed distal end and an inner flat surface between a tapered cutting edge and an outer edge, said first blade aria said second blade slidable over each other with each of said inner flat surfaces in close cutting engagement, a first handle of said first blade, a second handle of said second blade pivotally connected to said first handle, an intermediate portion of said first blade, provided with a first notch, said first notch being smooth and having a relatively constant depth, arranged between said cutting edge and its pivot, an intermediate portion of said second blade, provided with a second notch, said second notch being smooth and having a relatively constant depth, arranged between said cutting edge and its pivot, said first and second notches cooperate to form a noncutting area which receives cloth not to be cut, and an adjustable setting means mounted through said second handle and contacting said first handle, said setting means capable of adjustment to limit the movement of said first and said second blades;

placing said blunt end blade of said buttonhole scissors in contact with cloth at buttonhole to be cut; and closing said buttonhole scissors so that said cloth is cut and said buttonhole is opened.

7. The method of claim 6, wherein said adjustable setting means is a screw threadable through said second handle.

8. The method of claim 6, wherein said noncutting area formed by cooperation of said first and second notches is of sufficient size to avoid bunching of cloth not to be cut.

9. The method of claim 6, wherein said first and second cutting edges are of a length frequently used in the making of buttonholes.

* * * * *